US008220950B1

(12) United States Patent
Sunshine

(10) Patent No.: US 8,220,950 B1
(45) Date of Patent: Jul. 17, 2012

(54) DISTRESS MARKER SYSTEM

(76) Inventor: Morton Sunshine, Hollywood, FL (US)

( * ) Notice: Subject to any disclaimer, the term of this patent is extended or adjusted under 35 U.S.C. 154(b) by 541 days.

(21) Appl. No.: 12/427,720

(22) Filed: Apr. 21, 2009

(51) Int. Cl.
*F21L 4/02* (2006.01)

(52) U.S. Cl. ..... 362/184; 362/109; 362/205; 362/295; 362/208; 315/291

(58) Field of Classification Search ..... 362/202, 362/205, 206, 212, 221, 184, 800; 315/291, 315/307, 312
See application file for complete search history.

(56) References Cited

U.S. PATENT DOCUMENTS

| | | | | |
|---|---|---|---|---|
| 6,095,661 | A * | 8/2000 | Lebens et al. | 362/184 |
| 6,190,025 | B1 * | 2/2001 | Solinsky | 362/394 |
| 6,598,998 | B2 | 7/2003 | West et al. | |
| 7,723,921 | B2 * | 5/2010 | West | 315/200 A |
| 7,731,385 | B2 * | 6/2010 | Spartano et al. | 362/197 |
| 2005/0122712 | A1 * | 6/2005 | Kim | 362/184 |
| 2007/0145912 | A1 * | 6/2007 | Spartano et al. | 315/291 |

* cited by examiner

*Primary Examiner* — Ali Alavi
(74) *Attorney, Agent, or Firm* — H. John Rizvi; Glenn E. Gold; Gold & Rizvi P.A.

(57) ABSTRACT

A portable distress light including a plurality of light emitting diodes and a light mode switch to power the diodes so as to provide a flashing white light, a flashing infrared light, a flashing blue light and a steady white light. Status indicators are included on the device to correspondingly identify the operative mode selected. The light emitting diodes include top-emitting diodes and side-emitting diodes that are arranged on a printed circuit board in a variety of configurations to provide an optimum light pattern. Exemplary configurations include positioning the light emitting diodes into a triangular pattern, and a square or rectangular pattern. The distress device further includes a variety of reflectors that are disposed over the light emitting diodes to provide a horizontally dispersed light pattern. An operating circuit provides the benefit of a delay period between mode selections. An alternative embodiment provides a distress light including a cylindrically-shaped form having a top dome attached to a cylindrical body.

20 Claims, 14 Drawing Sheets

DISTRESS MARKER SYSTEM

FIELD OF INVENTION

The present invention relates to lighting devices, and more particularly, to a portable distress signaling device including multiple light emitting diodes (LED's) that are selectively operated by electronic circuitry to provide visual aid in search and rescue operations on land and at sea for both military and civilian operations.

BACKGROUND OF THE INVENTION

There are a number of distress signaling devices that are readily available to imperiled individuals who may be lost at sea or on land as a means of summoning search and rescue operations. The vast oceanic environment and large global landscape makes it extremely difficult to locate one or more individuals who may be lost. Search operations are frequently conducted by marine vessels, aircrafts, and land vehicles in an effort to cover a larger search area. Search teams often face difficult challenges and a variety of hurdles as they undergo their searching efforts. For example, the difficulty of finding lost individuals are often compounded by oceanic waves and debris, and natural land obstacles such as trees, brushes, and hills. Bad weather conditions can also hinder the search, thus increasing the amount of time spent searching.

Locating lost individuals can be even more challenging during military combat or operations. In military action, its important for the individual requesting aid to provide a discrete, distress signal without alerting the enemy of the location of the person, or surrounding search aircrafts or vehicles. In certain situations, a distress device may require a different mode of signaling during the night as opposed to daytime. Such devices must be durable, able to withstand extensive wear and tear resulting from exposure, handling, and use.

A large variety of rescue distress devices capable of generating a more visually intense distress signal have been adopted in an effort to overcome these challenging obstacles and to effectively locate an individual who is lost or in need of aid during civilian or military operations. Some examples of such distress devices include portable laser devices, flares, dyes, planar mirrors, incandescent, Xenon, or other strobe lights, and water-activated strobe lights. Most of these conventional devices have certain drawbacks, and many have limited use for military operations. For example, the portable laser devices are generally limited to a very narrow beam and therefore must be accurately aimed at the intended search and rescue personnel. Flares are temporary since they are active for only short periods of time. In addition, flares may have limited use in certain military situations since the flare provide strong visual effects readily seen by unfriendly forces. Planar mirrors are most effective in the presence of sunlight and thus are of limited or no use on cloudy days and during nighttime. Incandescent strobe lights are power inefficient. The water-activated strobe lights typically require water to generate power or activate to the operating circuit.

One popular prior art device is the portable strobe light as disclosed in Clark et al., U.S. Pat. No. 5,490,050. Clark et al. ('050) discloses a portable strobe light used in search and rescue emergency operations. The portable strobe light provides three different operating light modes. The portable strobe light includes a housing with a high intensity xenon bulb, which flashes white light. The portable strobe light includes mechanical interchangeable blue light and infrared light filters that are mechanically maneuvered about the housing to cover the xenon bulb so as to selectively provide an infrared or blue light. Though the portable strobe light may be useful in military operations, its functionality is limited by the use of moveable mechanical parts. Maneuvering the mechanical filters may be hindered over time as the portable strobe light is exposed to the weather, dust, dirt and grime. In addition, the moving parts are subject to damage or breaking when exposed to ongoing wear and tear.

Accordingly, there is a need in the art for a portable distress lighting device that is lightweight, durable, and includes a plurality of LED'S, efficiently arranged, to provide different signaling lights without the need for positioning mechanically maneuverable filters and a shield. There is also a need for a portable distress lighting device that includes a selective mode of operation with corresponding status indicators.

SUMMARY OF THE INVENTION

The present invention overcomes the deficiencies of the known art and the problems that remain unsolved by providing a portable distress marker system that includes a plurality of light emitting diodes (LED's) that are particularly arranged on a printed circuit board (PCB) and coupled to a power switch and mode switch to provide a flashing white light, a flashing infrared light, a flashing blue light, and a steady white light.

In accordance with the present invention, there is provided a portable distress light comprising a housing holding a power source and a circuit, a light assembly disposed on one end of the housing, where the light assembly includes a plurality of light emitting diodes coupled to the circuit, a transparent cover disposed over the plurality of light emitting diodes, a mode switch electrically coupled to the circuit for selectively powering the plurality of light emitting diodes to provide different lighting modes, a plurality of status indicators where each status indicator corresponds to the lighting mode selected, and a power switch electrically coupling the power source to the circuit for operating the LED's.

In an alternative embodiment there is provided a portable distress light including a plurality of light emitting diodes and a light mode switch to power the diodes to provide a flashing white light, a flashing infrared light, a flashing blue light and a steady white light. Status indicators are included on the device to correspondingly identify the operative mode in operation. The light emitting diodes include top-emitting diodes and side-emitting diodes that are arranged on a printed circuit board in a variety of configurations to provide an optimum light pattern. Exemplary configurations include positioning the light emitting diodes into a triangular pattern, a square pattern or a rectangular pattern. The distress device may further include a variety of reflectors that are disposed over the light emitting diodes to provide a horizontally dispersed light pattern.

An alternative embodiment provides a distress light including a cylindrically-shaped form having a top clear cover attached to a cylindrical body. The cylindrically-shaped device may be used where a smaller volume rescue aid is necessary.

DETAILED DESCRIPTION OF INVENTION

One or more embodiments of the present invention are disclosed herein. The embodiments are merely exemplary of the invention that may be embodied in various and alternative forms. It is noted that the various views, features, elements, and dimensions of the disclosed exemplary embodiments are not necessarily to scale, and may be enlarged, rotated, exaggerated, minimized, or sectionalized for clarity. Thus, specific structural and functional details, dimensions, shapes, or configurations disclosed herein are not limiting but serve as a basis for teaching a person of ordinary skill in the art the described and claimed features of the one or more embodiments of the present invention.

When describing or introducing elements, features, embodiments, structure, or variations, the terms "a", "an", "the", "it", and "said" as used herein and in the following claims, means or connotes the singular or plural. Certain terminology is utilized herein for purposes of providing one or more points of reference and is not intended for limiting the present invention to any specific construction, dimension, orientation, configuration, structure, view, or embodiment. For example, the terms "top", "bottom", "side", "left", "right", "front", "back", "rear", "upper", "lower", "length", "width", "height", "depth", "horizontal", "vertical", "above", and "below" are utilised herein to describe orientation of elements, features, or components, and to provide perspective, dimension, and reference within each drawing or figure.

Figure 1:
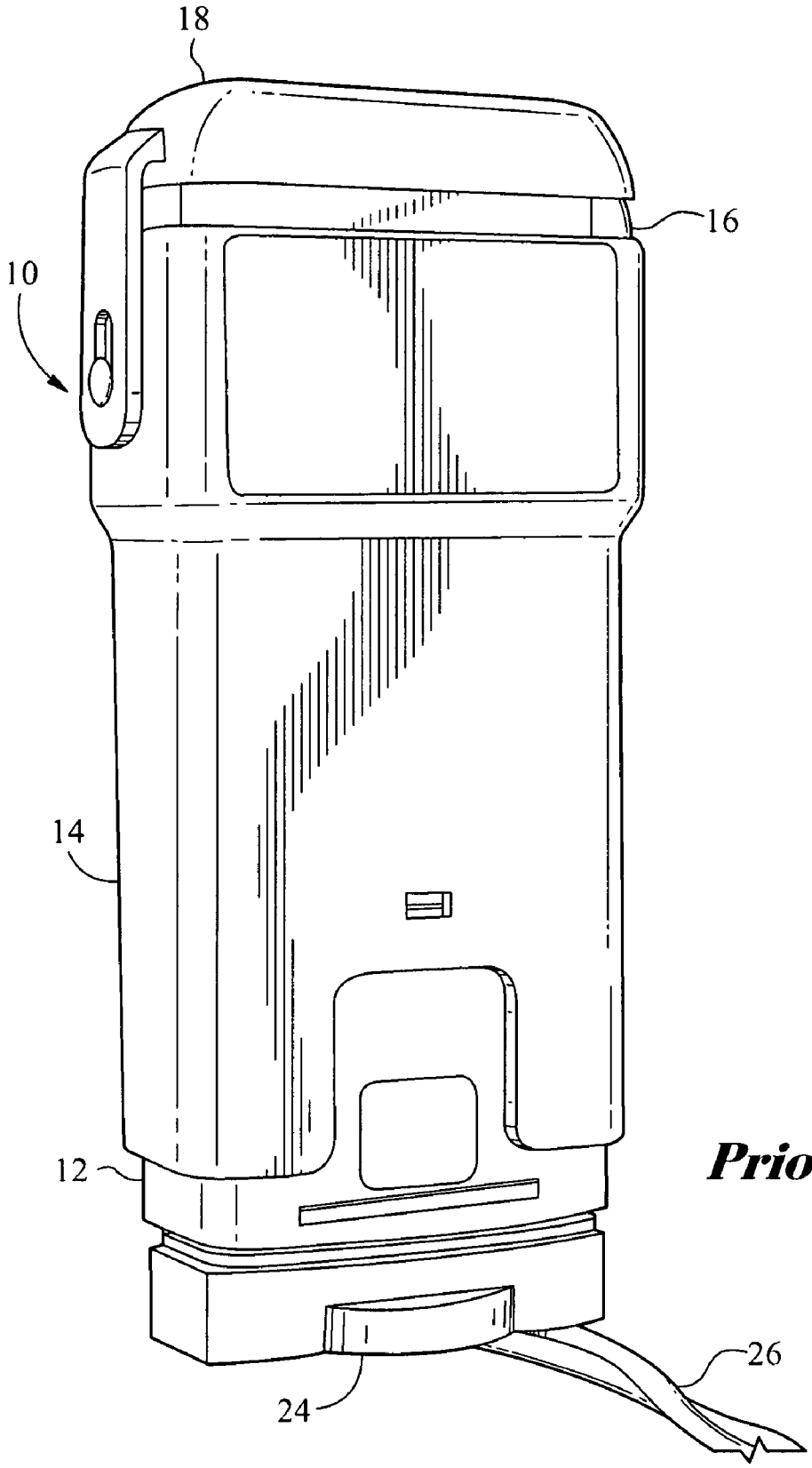
Prior Art FIG. 1
FIG. 1 is an isometric rear view of a portable strobe light, in accordance with known prior art.

Referring now to the drawings wherein like elements are represented by like numerals throughout, there is shown in FIG. 1, an isometric rear view of a portable strobe light, in accordance with known prior art. The portable strobe light 10 is designed to be used in both military and civilian operations. The strobe light 10 includes a body 12 and a guard 14 including an opening that is correspondingly sized to slideably receive the body 12 therein. Both the body 12 and guard 14 comprise a generally rectangular shape, and each is fabricated from a durable, plastic material. Body 12 includes a chamber (not shown) for housing a power source, such as batteries. The chamber is accessed via, a closure 24. A light-emitting bulb, such as a xenon bulb, (not shown) is positioned on the top end of the body 12 to emit a white visible light. A clear, transparent cover 16 is disposed over the light emitting bulb to protect the bulb from damage while allowing white light to transmit through the cover 16. An operating circuit is housed within the body 12 for operating the xenon bulb.

The portable strobe light 10 further includes an infrared filter (IR) 18 that is manually pivotable over the light emitting bulb cover 16 to provide infrared light. The IR filter 18 is made of a plastic material and acts to filter visible light at a particular wavelength allowing IR frequencies to pass through the filter 18. Because the IR light is invisible to the naked eye, a user is able to use the strobe light 10 in military combat thereby avoiding the possibility of detection and exposure that would likely be caused by the bright white light. As illustrated in FIG. 1, the portable strobe light 10 further includes a lanyard 26 for easily carrying the portable strobe light 10 by hand or around the neck of a person, or attaching the portable strobe light 10 to a surface or object, if desired.

Figure 2A:
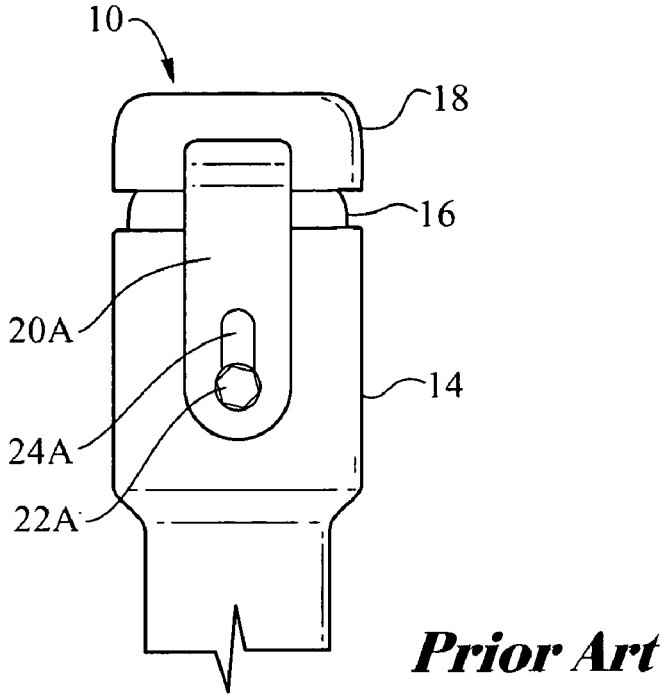
FIG. 2A is a side elevational view of the portable strobe light of FIG. 1, showing an infrared filter operatively positioned over a top cover, in accordance with known prior art.
Figure 2B:
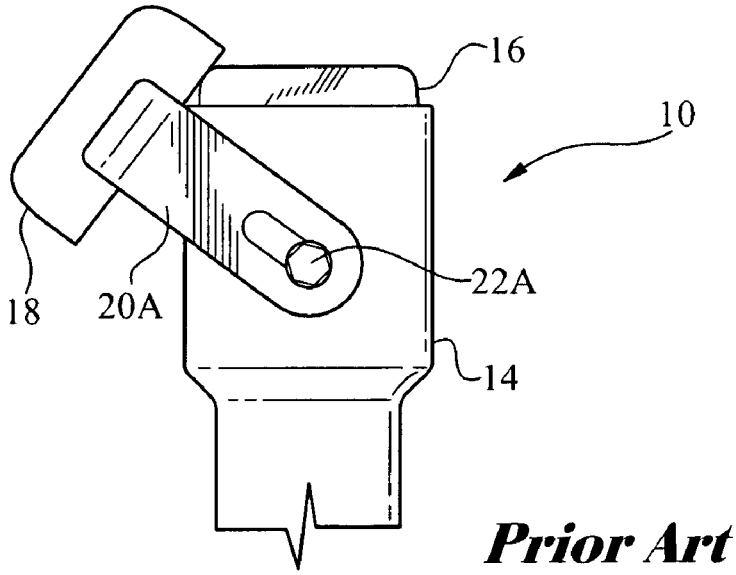
FIG. 2B is a side elevational view of the portable strobe light of FIG. 1, showing the infrared filter pivotably positioned away from the top cover, in accordance with known prior art.

Turning now to FIGS. 2A and 2B, there are shown side elevational views of the portable strobe light of FIG. 1, according to the known prior art. In FIG. 2A, the IR filter 18 is shown in an operational position. The IR filter 18 generally comprises a concave shape to fit tightly over the convex shape of bulb cover 16. It is noted, although the IR filter would normally be lowered and provide a light seal about the bulb, the IR filter 18 is shown in a slightly raised position providing visual access to the bulb cover 16. The tight fit of both the IR filter 18 and bulb cover 16 prevents light from escaping about the edges of cover 16. As seen, the IR filter 18 includes a pair of support members 20*a*, each support member 20*a* including an aperture 24*a*. A pair of mounting posts 22*a* is attached to the outer side surfaces of guard 14, opposite each other. It will be noted that although reference is made to a singular support member, mounting post, and aperture, a second corresponding support member, mounting post, and aperture forming a pair is operatively included but not shown.

Each mounting post 22*a* correspondingly extends through each aperture 24*a* of each support member 20*a* to permit the IR filter 18 to pivot about the posts 22*a* between an operational position as shown in FIG. 2A, to a non-operational position in which IR filter 18 is manually pivoted away from bulb cover 16 to allow white light to pass through the transparent cover 16, as better illustrated in FIG. 2B. Thus, by pivoting the IR filter 18 about the mounting post 22*a*, a user can manually select between a white light operating position, and an infrared light operating position.

Figure 3A:
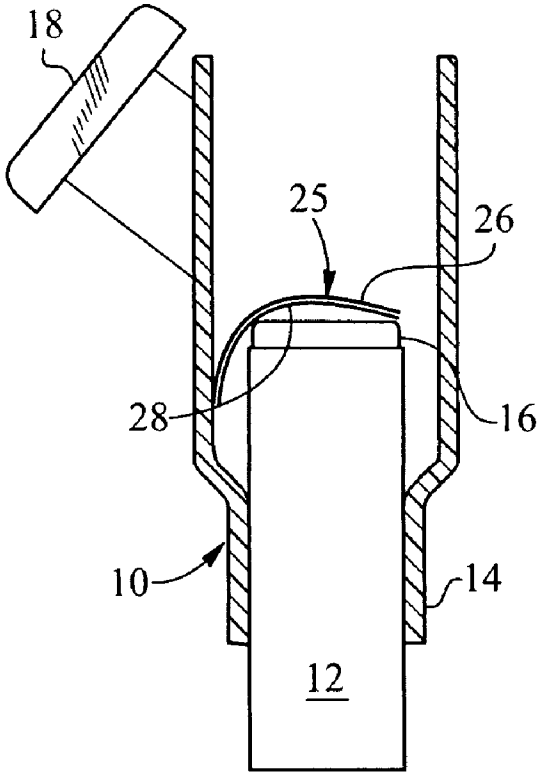
FIG. 3A Prior Art
FIGS. 3A through 3C are side elevational views of the portable strobe light of FIG. 1, showing the operative positioning of a blue filter over the top cover, in accordance with known prior art.
Figure 3B:
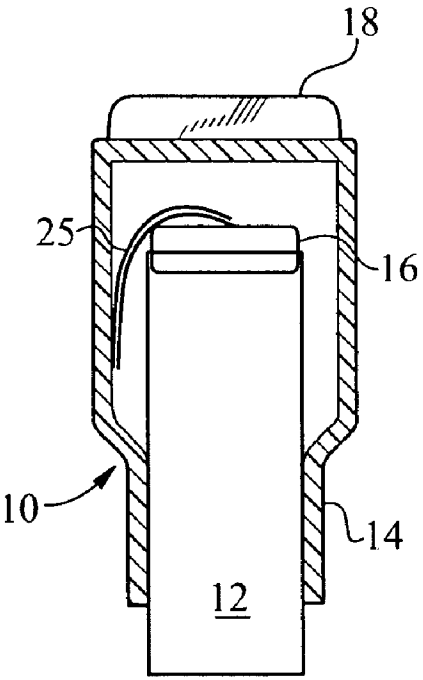
FIG. 3B Prior Art
Figure 3C:
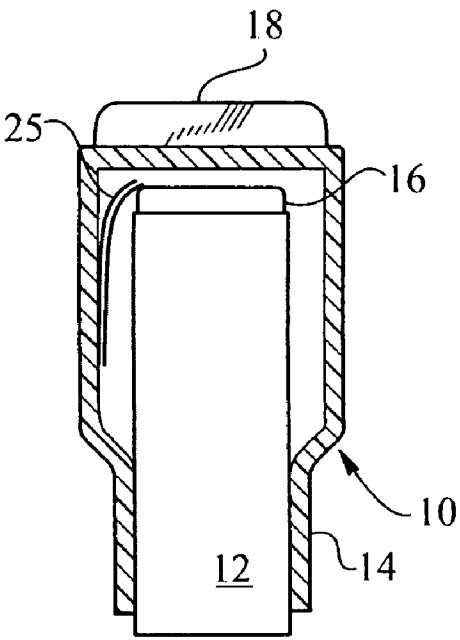
FIG. 3C Prior Art

With reference now made to FIGS. 3A through 3C, there are shown side elevational views of the portable strobe light 10 of FIG. 1, in accordance with the known prior art. As shown, portable strobe light 10 includes an internally mounted blue light filter assembly 25. The blue light filter assembly 25 includes a resilient spring 26 attached adjacent to a thin, flexible plastic blue light filter 28 to form a naturally U-shaped bend. The spring 26 includes a smaller dimension than the blue filter 28 so as not to obscure the lens area of the blue filter 28. As seen, one end of the blue light filter assembly 25 is attached to the inner surface of guard 14.

As illustrated in FIG. 3A, to select a blue light operating position, IR filter 18 is manually pivoted into a non-operational position. Guard 14 is slideably pulled into an extended position, longitudinally, (i.e. guard 14 is pulled upwardly while the body 12 remains fixed, or alternatively, body 12 is pulled downwardly while guard 14 remains fixed), such that spring 26 forces the blue filter 28 to bend into a natural U-shaped position, over the top of bulb cover 16 to cover the xenon bulb (not shown). Thus, when guard 14 is fully extended, the blue light filter assembly 25 bends fully over the bulb cover 16 to provide a blue light operating position. The blue light can be used in combat during nighttime to provide a blue light beam without detection from the enemy.

As guard 14 is slideably pushed downwards while body 12 remains fixed or alternatively, as body 12 is pulled upwards while the guard 14 remains fixed, the spring 26 forces the blue filter 28 to move away from the top surface of bulb cover 16, as better illustrated in FIGS. 3B and 3C. Thus, when the guard 14 is fully retracted, the blue light filter assembly 25 is fully displaced away from top surface of the bulb cover 16 so that both the spring 26 and pliable blue filter 28 are displaced into a straight storage position, as seen in FIG. 3C. It will be noted that in FIGS. 3B and 3C, the IR filter 18 is manually pivoted into operational position over bulb cover 16 to provide infrared light.

The known prior art provides a portable strobe light 10 that includes three operational light modes using manually activated light filters 18 and 25. A first operational light mode includes a white strobe light provided by a xenon bulb emitting bright white light through a clear cover 16 used for military or civilian search and rescue operations. A second operational light mode is provided by manually pivoting an IR filter 18 over the bulb cover 16 to provide infrared light used in military missions and to transmit infrared light to infrared viewers implemented by friendly forces. A third operational light mode is provided by manually pivoting the IR filter 18 into a non-operational mode, and extending guard 14 fully to position a blue filter over the cover 16 to provide a blue light that may also be used in military combat. Thus, there is provided in the prior art a portable strobe light 10 with mechanical filters 18, 25 to selectively provide a white light, an infrared light or alternatively, a blue light.

Figure 4:
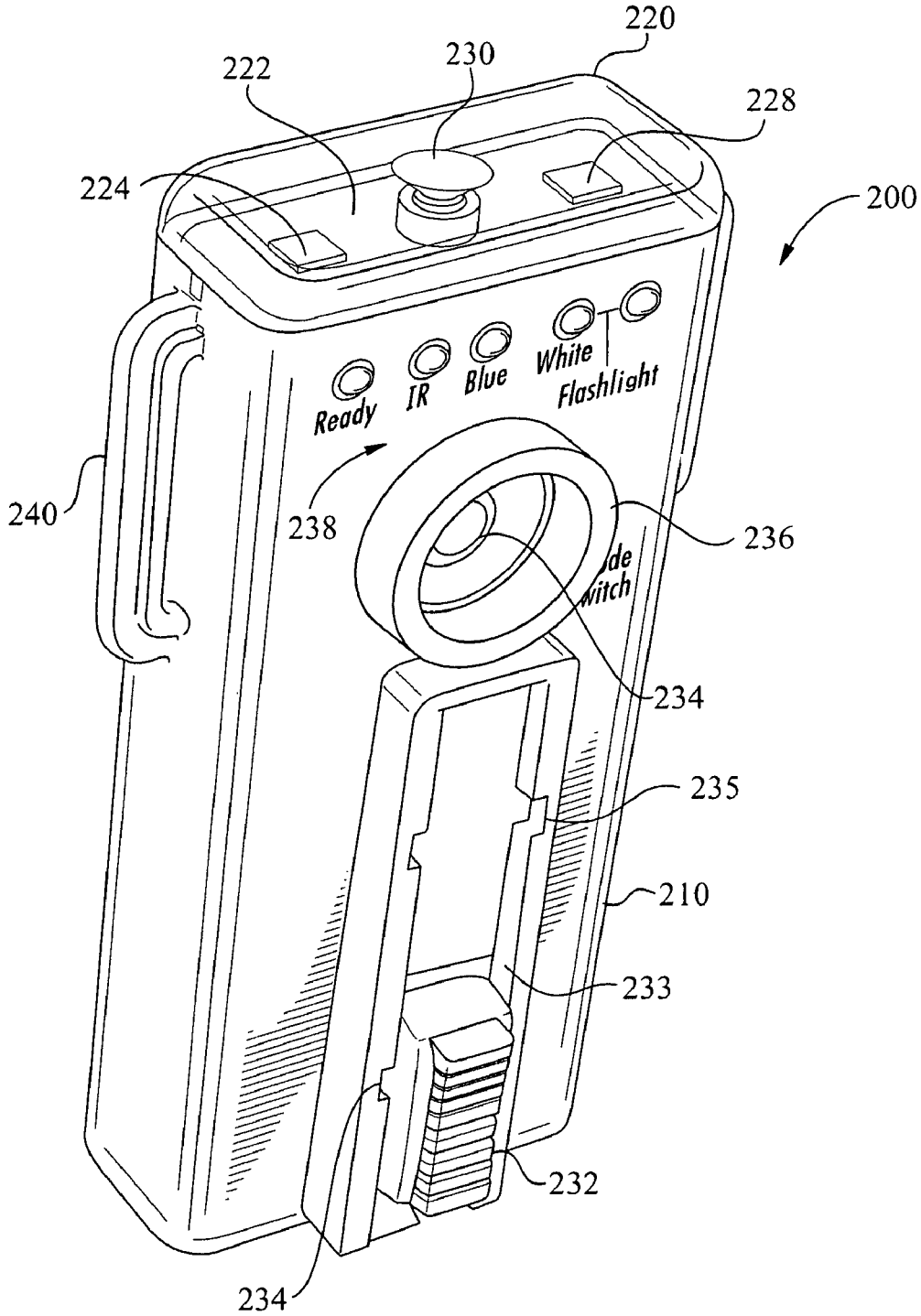
FIG. 4 is an isometric view of a portable distress marker, in accordance with one embodiment of the present invention.

Referring now to FIG. 4, there is shown an isometric view of a portable distress light 200, according to one embodiment of the present invention. The distress light 200 includes a generally rectangular shaped body 210 that is fabricated from a durable, plastic material, such as a polycarbonate plastic. Body 210 may comprise any color, and may include camouflage markings or colors. One or more holding elements 240 are disposed along one or more outer side surfaces of body 210. In one exemplary embodiment, the holding element 240 may comprise a U-shaped member having an opening for receiving a cord, lanyard, strapping, and the like, therein for attaching the distress light 200 to a person or object. Distress light 200 further includes a light assembly 222, a top cover 220, a power switch 232, a mode switch 234, and a plurality of status indicators 238.

Cover 220 is fabricated from a clear, transparent, plastic material, and is fixedly disposed on top of the distress light 200 to cover light assembly 222. The cover 220 protects the light assembly 222 from damage and provides a watertight seal to prevent water from entering into the cavity of the light assembly 222.

Body 210 of distress light 200 includes a chamber that is dimensioned for housing an operating circuit and power source (not shown) for powering both the status indicators 238 and light assembly 222. A representative example of a power source includes 2 or more batteries, such as CR-123 battery cells.

Light assembly 222 includes light emitting diodes (LED's) that replace the conventional xenon bulb of the known prior art. Light assembly 222 includes a plurality of LED's that are arranged in an innovative configuration to achieve a hemisphere of light. Each LED is carefully selected and electrically mounted to radiate light upwards and/or sideways. A plurality of LED's is arranged in a variety of different configurations to provide an effective, intense illumination. The LED's are selected to provide a flashing white light, a flashing infrared (IR) light, a flashing blue light, and a solid white flashlight. It will be noted that the plurality of LED's may be selected to provide other colors or variations, and powered to pulse, flash, strobe, or remain solid.

In one exemplary embodiment of the present invention, light assembly 222 includes two top-emitting LED's 224, 228 and one side-emitting LED 230, as illustrated in FIG. 4. The configuration is such that the LED's 224, 228, 230 provide a hemisphere of white emitted light. One practical application for each top-emitting LED 224, 228 includes the use of the OVSPxBCR4 diode series from OPTEK Technology Inc. as an exemplary component incorporated in the prototype. The OVSPxBCR4 diode series is a robust energy-efficient LED source that provides a 120 degree viewing angle, comprises a ultra-low profile, has a long operating life, and provides a variety of different emitting colors including blue, green, red, yellow, and the white LED, identified as part no. OVSPW-BCR4. Still, a practical application for the side-emitting LED 230 includes the use of the LUXEON III diode series from LumiLED's Lighting Company. More particularly, the Luxeon LXHL-DW09 LED is a light emitting diode that includes a top lens, and a body, and provides a side-emitting white light. The LXHL-DW09 LED is ultra-compact, provides long operating life, provides a variety of different emitting colors, is energy efficient, and requires low DC voltage to operate.

It will be noted that the present invention is not limited to a light assembly 222 having a particular number or arrangement of LED's. It is shown and contemplated that a number of LED's can be placed in different arrangements as described further to exemplary embodiments shown in FIGS. 5 through 11 below.

Distress signaling device 200 further includes a waterproof, power switch 232 for selectively activating LED's 224, 228, and 230. In one non-limiting example, the waterproof power switch 232 includes a magnetic slide switch often used in areas where spark proof switching is desired in the event the distress light 200 is used near combustible materials or environment that includes flammable products. A slide channel 233 is formed on the outer surface of distress light 200 to guide the switch 232 along a longitudinal channel to operate distress light 200 between the on/off positions. Slide channel 233 includes detents 234, 235, for holding and locking the switch 232 securely into position. It will be noted that power switch 232 may include other suitable mechanical or electrical contact devices or switches.

With continued reference to FIG. 4, distress light 200 further includes a mode switch 234. Mode switch 234 may comprise a mechanical or electrical switch that includes waterproof features. An outer rubber, elastomer covering may be disposed over mode switch 234 to prevent water, debris or dust from affecting the performance of the switch 234. As shown, mode switch 234 is surrounded by a protection barrier 236 to prevent a user from accidentally depressing mode switch 234. For example, without a protection barrier 236, a user may accidentally hit mode switch 234 while in combat, activating an undesirable LED mode of operation and alerting the combat enemy. Thus, to prevent the accidental activation of mode switch 234, the present invention offers the benefit of a protection barrier 236 that extends along the outer perimeter of switch 233 and is slightly raised upwards to provide an effective barrier.

A plurality of low current status light emitting diodes (SLED's) are disposed within the body 210 of the light 200 to indicate to a user the operative status of the light assembly 222. In one exemplary embodiment, status indicators 238 include a ready light (Ready), an infrared indicator light (IR), a blue light indicator (Blue), and white indicator light (White) and a Flashlight indicator light (steady light). Each status indicator 238 corresponds to the operative mode selected, via mode switch 234, for powering the LED's.

In operative use, distress light 200 is initially powered on by sliding power switch 232 along slide channel 233 into an "on" position. It will be noted that powering on distress light 200 simply activates the device 200 in the ready mode, unlike the prior art devices where once the unit is powered on, power is immediately applied to the xenon light bulb circuit. Placing distress light 200 in the ready mode provides the user the necessary time to make the appropriate selection for the mode of operation before powering the various LED's thus, reducing or eliminating the risk of exposure during military combat or missions.

A mode of operation is selected by sequentially depressing mode switch 234. In one non-limiting example, mode switch 234 is pressed once to operate the LED arrangement in an infrared (IR) strobe mode. Pressing mode switch 234 again places distress light 200 into a blue strobe mode, pressing the switch 234 again provides a white strobe mode, pressing switch 234 again provides a flashlight mode, pressing switch 234 again provides a back to ready mode, and the sequence repeats itself when repeatably depressing the mode switch 234.

As the mode switch 234 is depressed to select a desired mode of operation, the user is provided with a corresponding status indicator 238. The status indicator 238 shows the function that has been selected by the user. In one exemplary embodiment, when the distress light 200 is in the ready mode, the ready status indicator is illuminated. When distress light 200 is in the IR mode, the IR status indicator is RED. When the distress light 200 is in the Blue mode, the Blue status indicator is BLUE, when the light 200 is in the white strobe mode, the white status indicator is WHITE, and finally, when the distress light 200 is in the flashlight mode, both the white status indicator and flashlight status indicator are both illuminated. It will be noted that each status indicator LED is not limited to a particular color and that each LED status indicator may comprise a variety of different colors that may be preselected at the factory when assembling distress light 200. Preferably, the status indicator LED's are low current light emitting diodes.

Figure 5:
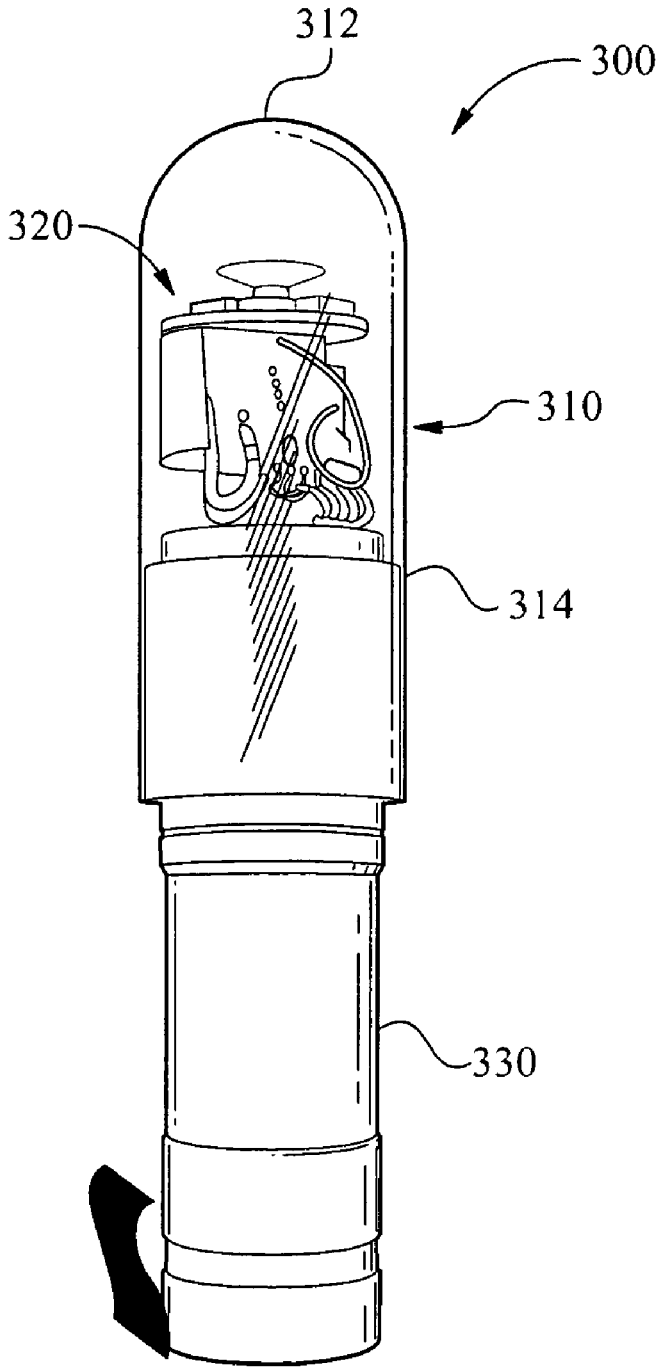
FIG. 5 is an isometric view of a distress marker, in accordance with an alternative embodiment of the present invention.

Turning now to FIG. 5, there is shown an isometric view of a distress light 300, in accordance with an alternative embodiment of the present invention. The distress light 300 comprises a generally cylindrically-shaped device having a transparent dome 310 attached to a cylindrical body 330. The dome 310 includes a convex dome top 312 integrally formed with a dome body 314. The dome 310 may be fabricated from glass, or a transparent plastic material. It will be noted that although the dome body 314 is shown attached to the outer end of cylindrical body 330, it is contemplated that body 314, of dome 310, may be alternatively attached or inserted within the cylindrical body 330. In one non-limiting example, a ferrule (not shown) may be inserted over the dome body 314 to secure the dome 310 to the cylindrical body 330. Cylindrical body 330 may be fabricated from any one of metal, aluminum, brass, stainless steel, plastic, or any other suitable material; in addition the cylindrical body 330 may also be coated with a waterproof or water resistant material, if desired.

Cylindrical body 330, of distress light 300, can be sized and dimensioned to fit within a standard 1" rifle stock clamp.

Figure 6:
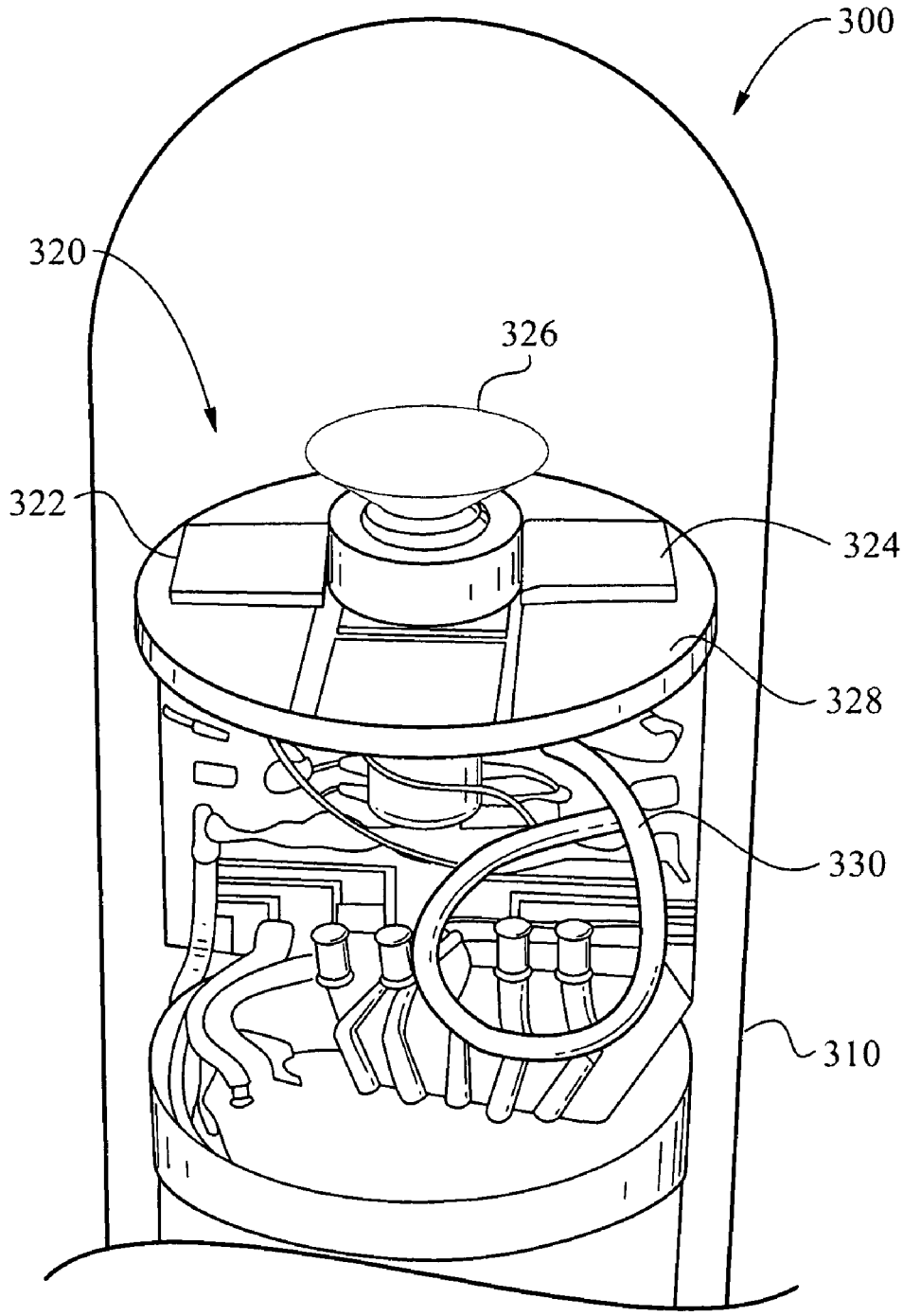
FIG. 6 is a sectional view of the distress marker of FIG. 5, showing an enlarged view of a light assembly, according to one embodiment of the present invention.

As better illustrated in FIG. 6, distress light 300 includes a light assembly 320 including a plurality of LED's 322, 324, 326 electrically arranged on a printed circuit board (PCB) 328. Light assembly 320 and corresponding circuitry is positioned at one end of body 330 with dome 310 protecting the light assembly 320 from damage. In one exemplary embodiment, light assembly 320 includes two top-emitting LED's 322, 324, and one side-emitting LED 326 to provide a light output. The light output can be of any of the series of white, IR, or blue light, having a plurality of LED's being the same color, a plurality of LED's each being a different output color, or a combination therewith. It will be noted that although FIG. 6, shows a hardwired LED light assembly 320, in a preferred embodiment, the LED light assembly 320 and circuitry 330 is compactly configured and engineered onto a semiconductor PCB layout using well known industrial processes.

Figure 7:
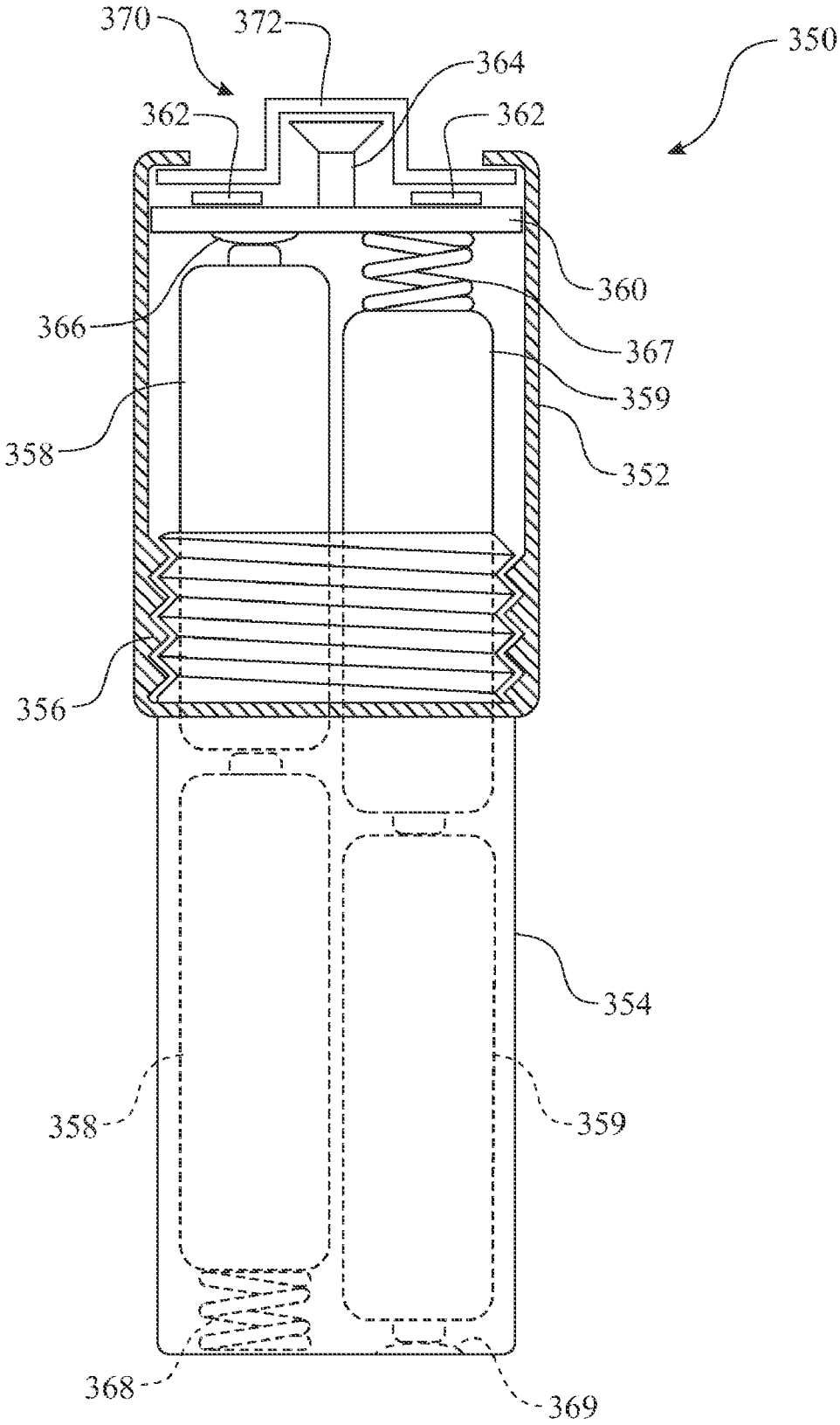
FIG. 7 is a sectioned elevational view of a light assembly, according to an alternative embodiment of the present invention.

Referring to FIG. 7, there is shown a sectioned elevational view of a distress light 350. In the exemplary embodiment, the distress light 350 can be of any form factor, with the illustrated example being a two-piece housing. An upper housing portion 352 can be assembled to a lower housing portion 354 via a threaded interface 356 and sized to accommodate at least one portable power cell 358. The distress light 350 includes a printed circuit assembly 360 having a side emitting diode 364 being centrally located and a pair of top emitting diodes 362 spatially located from the center. The side emitting diode 364 is positioned into a cylindrically shaped receiving section 372 of a lens 370. The top emitting diodes 362 are positioned emitting light axially through a planar portion of the lens 370. An electrical power contact 366 can be provided on an opposing side of the printed circuit assembly 360. A second electrical contact 368 is in electrical communication with the printed circuit assembly 360. It is understood a switch of some form factor, such as those illustrated herein can be included in the distress light 350. The printed circuit assembly 360 can include the circuit (or portions thereof) described throughout the specification.

Figure 8:
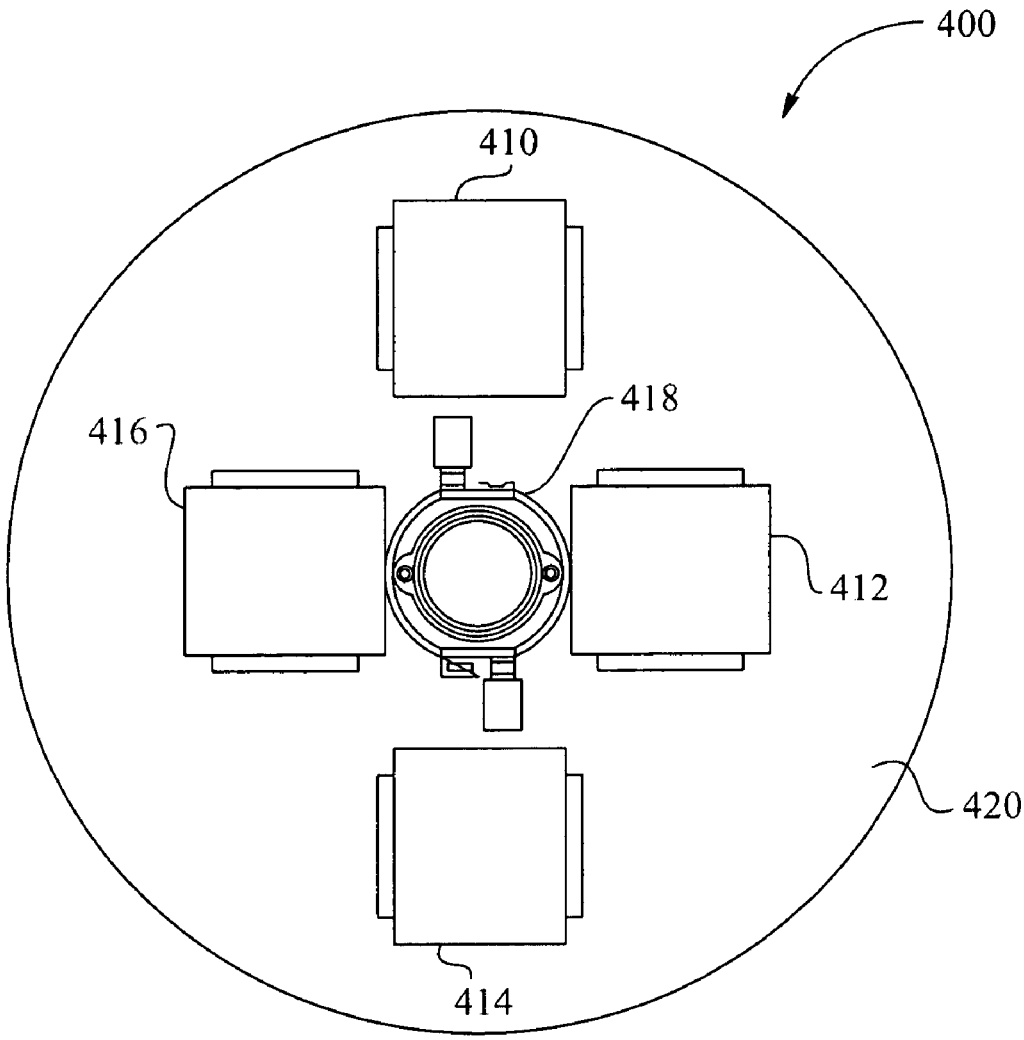
FIG. 8 is a top elevational view of a light assembly, according to an alternative embodiment of the present invention.

Referring now to FIG. 8, there is shown a top elevational view of a light assembly, in accordance with another embodiment of the present invention. In this exemplary embodiment, light assembly 400 includes four top-emitting LED's 410, 412, 414, 416, selected to radiate light upwards, and one side-emitting LED 418. The LED's 410, 412, 414, 416, 418 are arranged onto a PCB 420 to achieve an optimum hemisphere of light. As noted earlier, representative examples of top-emitting diodes includes the OVSPxBCR4 series diode from OPTEK Technology Inc., and the side-emitting diode may include the LUXEON III series diode from the LumiLED's Lighting Company. Light assembly 400 is configured to provide white light, IR light and blue light. In addition, light assembly 400 may provide a strobe light via, a unique electrical circuit, and a bright flashlight illumination.

Figure 9A:
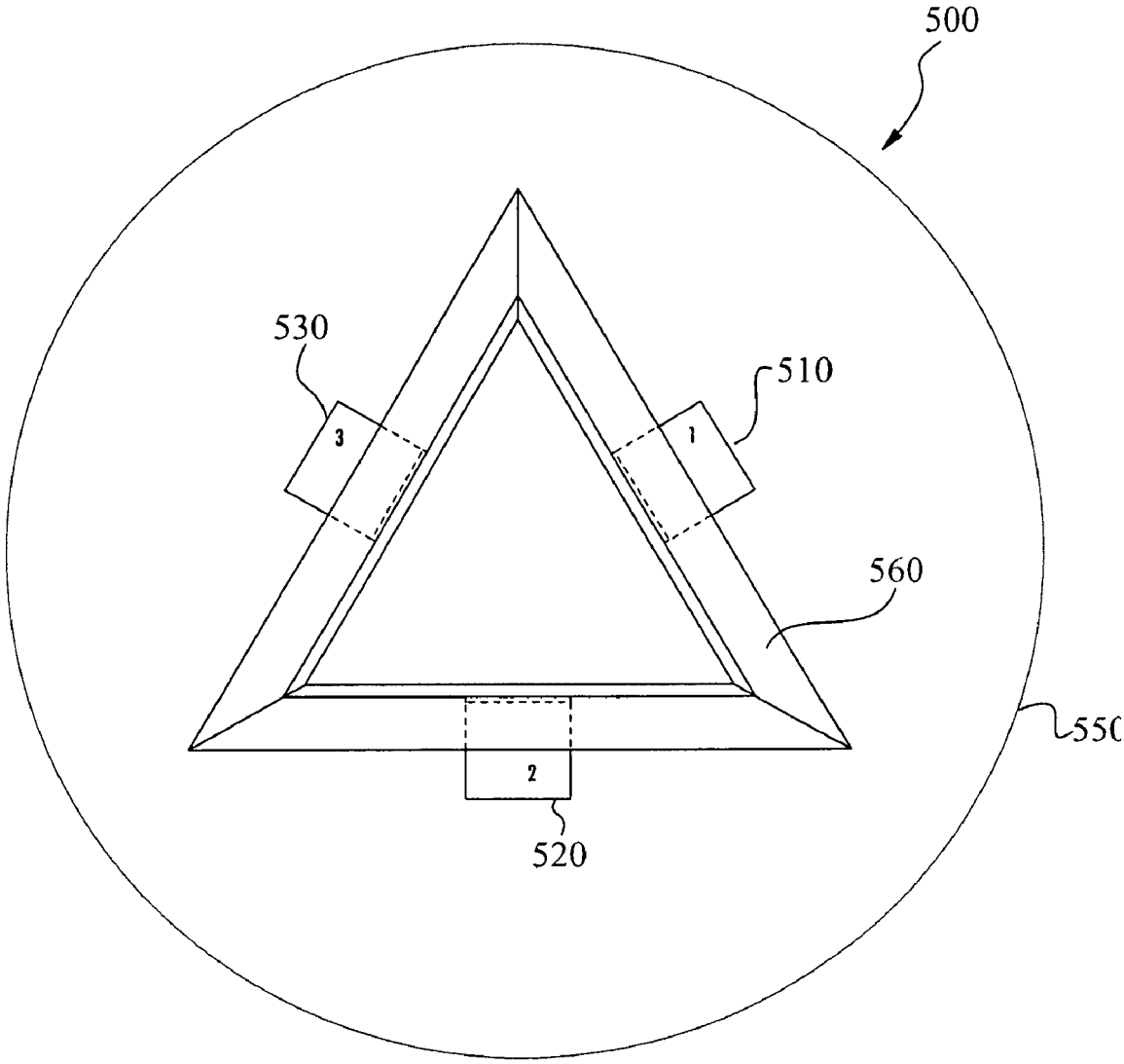
FIGS. 9A and 9B, are a top elevational view, and a perspective view, respectively, of a triangular shaped reflector fixedly disposed over a plurality of LED devices, according to one embodiment of the present invention.
Figure 9B:
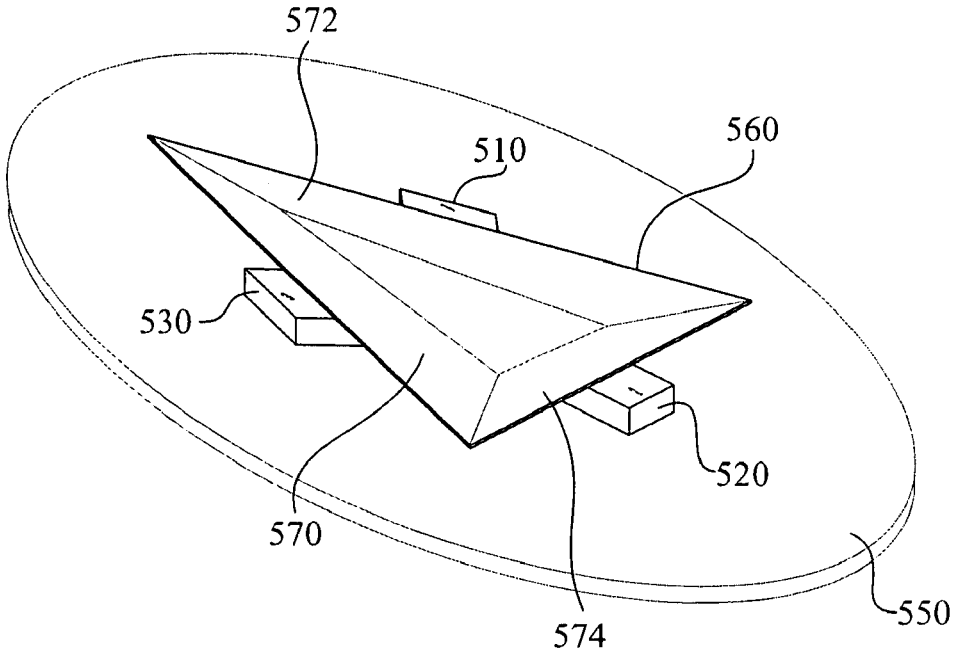
Figure 9C:
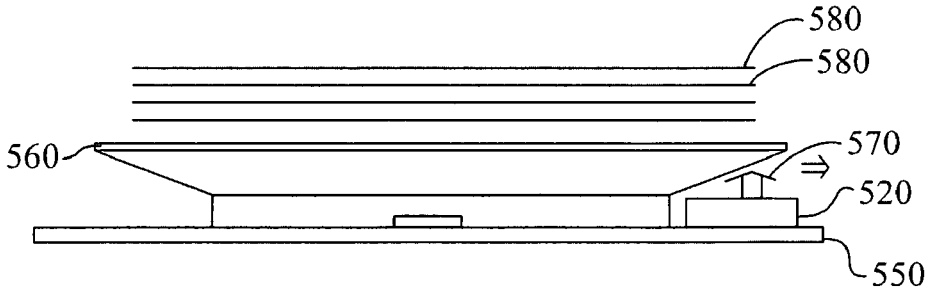
FIG. 9C is a front elevational view of the triangular shaped reflector disposed over the plurality of LED devices of FIGS. 9*a* and 9*b*, showing a horizontal reflective light pattern.

Turning now to FIGS. 9A through 9C, there are shown alternative embodiments of a light assembly including a light reflector. As illustrated in FIG. 9A, there is shown a top elevational view of a light assembly 500 including a factory installed, triangular shaped reflector 560, according to another embodiment of the present invention. Light assembly 500 includes three LED's 510, 520, and 530. The LED's 510, 520, and 530 may comprise top-emitting diodes, side-emitting diodes, or any combination thereof. Each LED 510, 520, 530 is physically oriented or arranged in a triangular format.

As better illustrated in FIG. 9B, each LED 510, 520, 530 is mounted onto PCB 550. A generally triangular shaped reflector 560 including edges 570, 572, 574 to form 45 degrees beveled surfaces, is mounted or disposed over the LED's 510, 520, 530 to cover all or a portion of the radiating surface of each LED 510, 520 or 530. In one non-limiting example, reflector 560 covers approximately half the radiating surface area of each LED 510, 520, and 530. The operative use of reflector 560 transforms vertically emitted light 570, from LED 510, 520, 530, into horizontally dispersed light waves 580, as better illustrated in FIG. 9C. Thus, reflector 560 is used to alter the vertically emitted light pattern into a horizontally dispersed light pattern. This alteration is beneficial where a 180 degree (hemisphere) of light may be desired.

Figure 10:
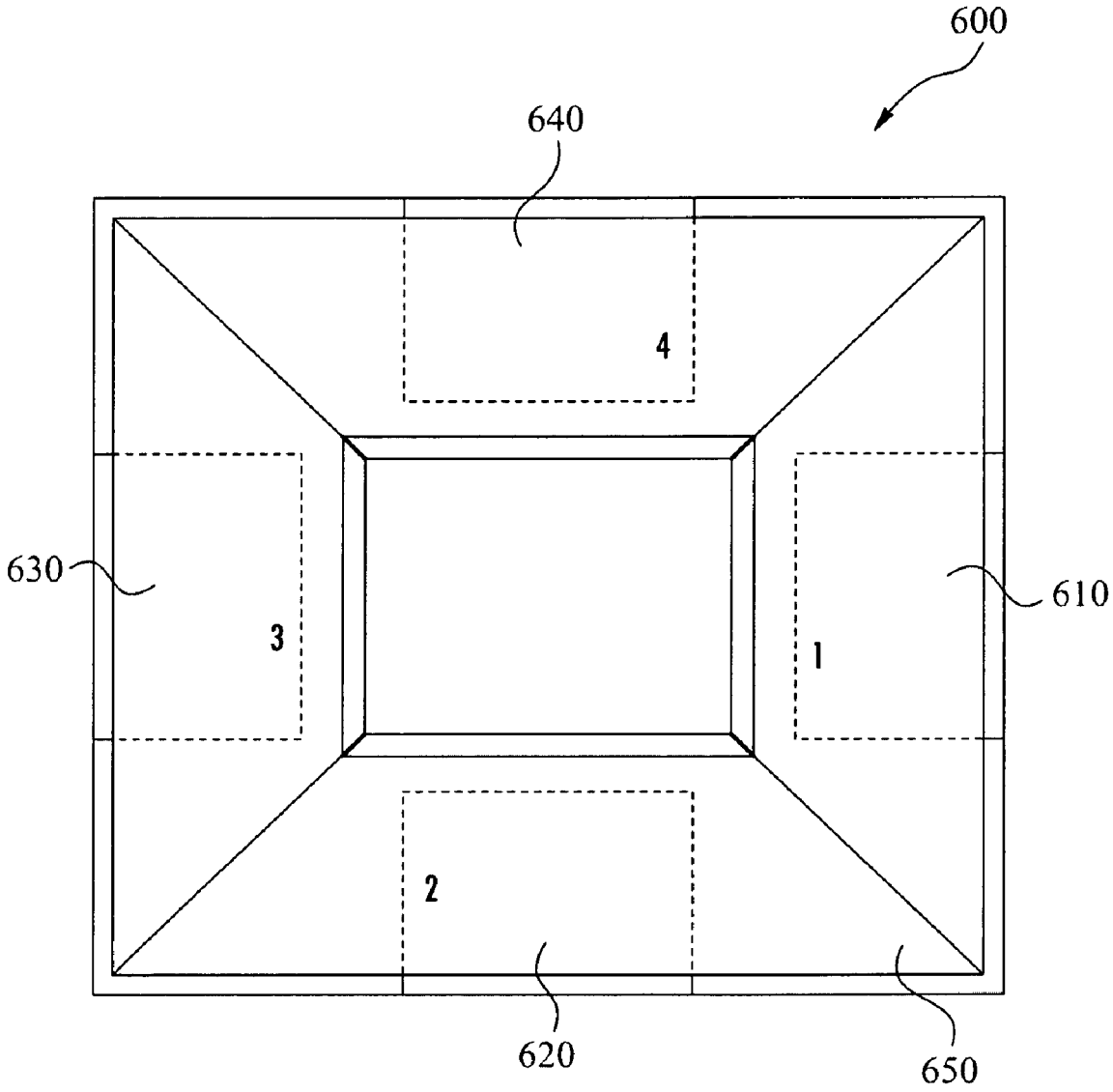
FIGS. 10 and 11 are top elevational views of a generally square reflector fixedly disposed over a plurality of LED devices, according to another embodiment of the present invention.
Figure 11:
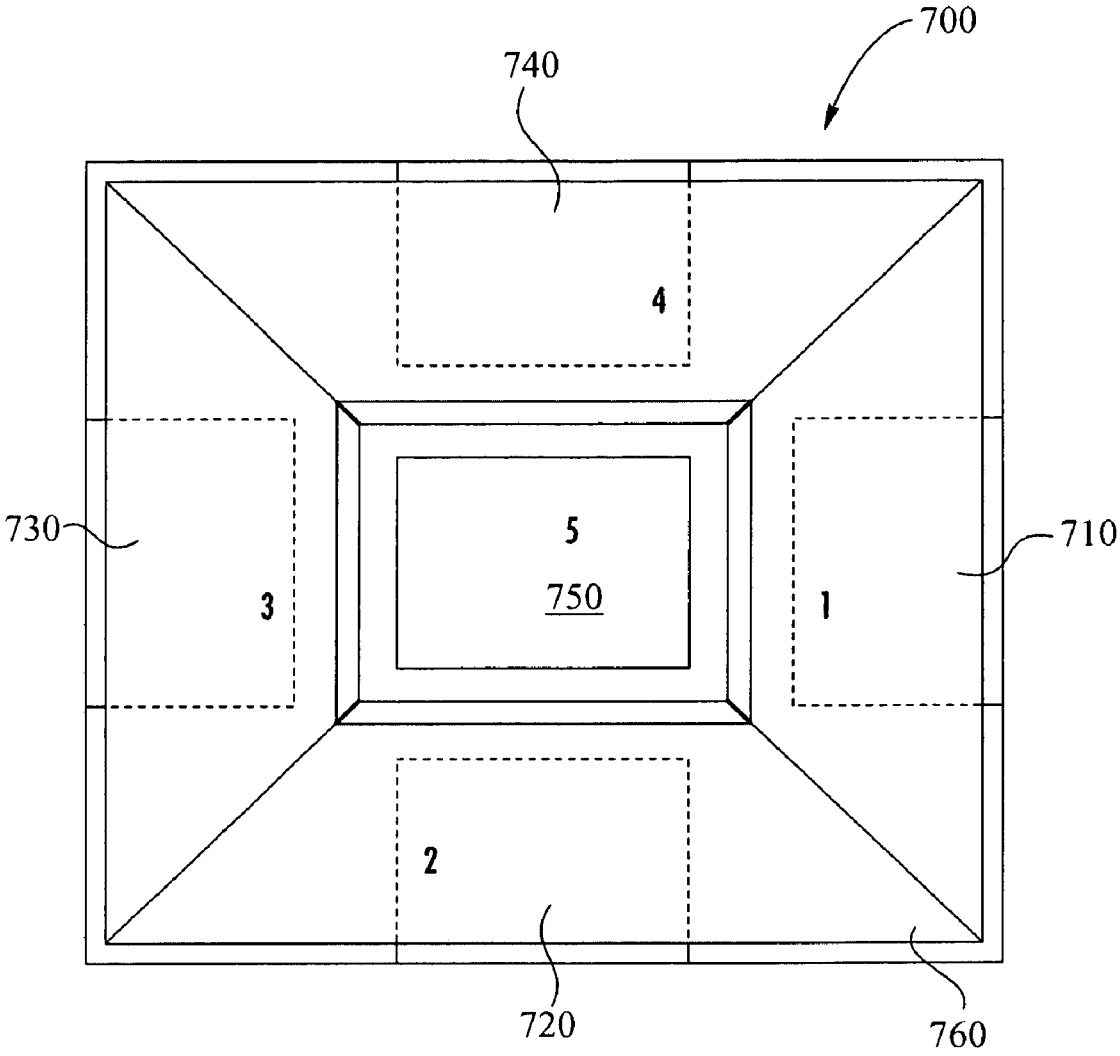

Referring to FIGS. 10 and 11, top elevational views of a light assembly including a reflector, according to alternative embodiments of the present invention. As shown in FIG. 10, light assembly 600 includes four LED's 610, 620, 630, and 640. LED's 610, 620, 630 and 640 may comprise top-emitting diodes, side-emitting diodes, or any combination thereof. LED's 610, 620, 630, 640 are arrangeably mounted onto a PCB in a square or rectangular pattern or configuration. A reflector 650 is mounted over LED's 610, 620, 630, 640 to cover all or a portion of the radiating surface area of each LED 610, 620, 630 and 640. Reflector 650 may include a plurality of edges defining 45 degrees beveled surfaces. In one alternative embodiment, reflector 650 may extend beyond the four LED's 610, 620, 630, 640 to generate a strong horizontal beam of light.

Referring to FIG. 11, a top elevational view of a light assembly with a reflector, according to another embodiment of the present invention. The elements and features of FIG. 11 are similar to that of FIG. 10, with the exception of an additional LED positioned in the center of the PCB and in the center of a reflector 760. Light assembly 700 includes five LED's 710, 720, 730, 740, and 750. LED's 710, 720, 730, 740, and 750 may comprise top-emitting diodes, side-emitting diodes, or any combination thereof. Each LED 710, 720, 730, 740, is mounted onto a PCB in a square or rectangular pattern or format, with LED 750 mounted in the central region. A reflector 760 is mounted over LED's 710, 720, 730, 740 to cover all or a portion of the radiating surface area of each LED 710, 720, 730 and 740. Reflector 760 may include a plurality of edges defining 45 degrees beveled surfaces to transform radiated light from a vertical pattern to a horizontal pattern. Reflector 760 may include a central opening for allowing LED 750 to radiate light upwards therethrough.

Thus, as shown in FIG. 9A through FIG. 11, a light assembly may include a plurality of LED's 510, 520, 530, 610, 620, 630, 640, 710, 720, 730, 740, 750, that are arranged on a PCB in different configurations including a triangular configuration, a square configuration and a rectangular configuration where a reflector 560, 660, and 760 is mounted over each LED 510, 520, 530, 610, 620, 630, 640, 710, 720, 730, 740 to cover a portion or all of each LED's radiating surface area so as to provide a horizontal light pattern.

Figure 12A:
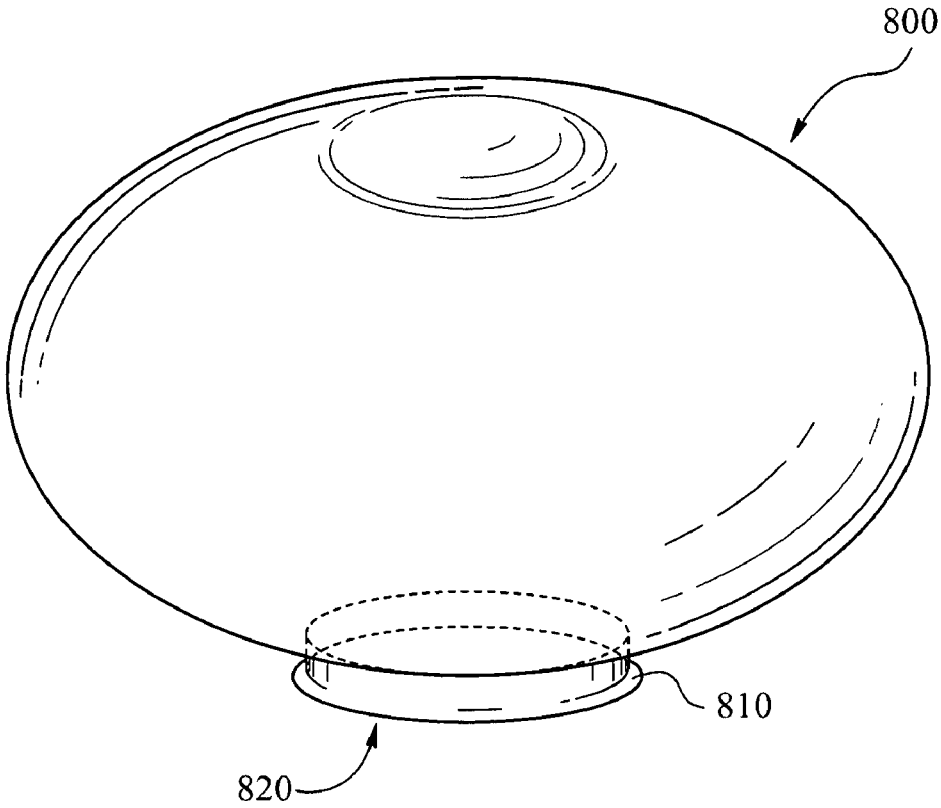
FIGS. 12A and 12B are isometric views of a torridal light cover for use with the distress marker of the present invention.
Figure 12B:
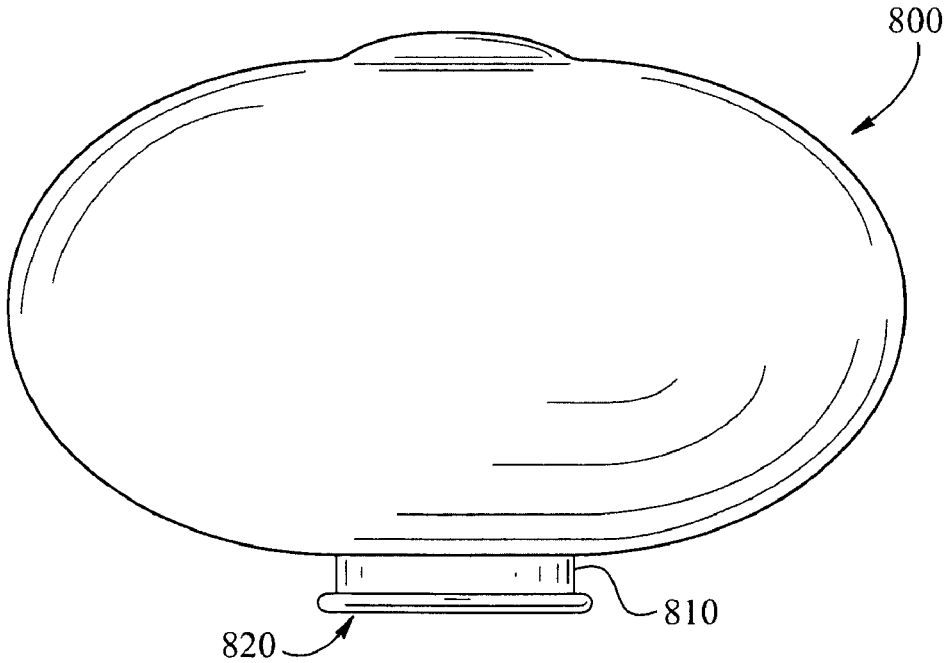

Turning now to FIGS. 12A and 12B, there are shown an isometric view and a front elevational view, respectively, of a light cover, according to an alternative embodiment of the present invention. The light cover 800 comprises a torridal cover defining an oval style lens cover. Light cover 800 includes a neck 810 and opening 820 for receiving a light assembly. In one non-limiting example, the torridal cover 800 is sized to attach to cylindrical body 310 of the cylindrically-shaped distress light 300, as illustrated in FIG. 6. Light cover 800 may be fabricated from glass, or a clear, transparent plastic material, and include a fastening means to securely fasten the cover 800 to the body 310 of light 300. The cover 800 may comprise a reflecting material that is coated to the outer or inner surface, may include a variety of different colors, and may comprise any size or shape. This light cover may be used with one side-emitting LED 326 (FIG. 6).

Figure 13:
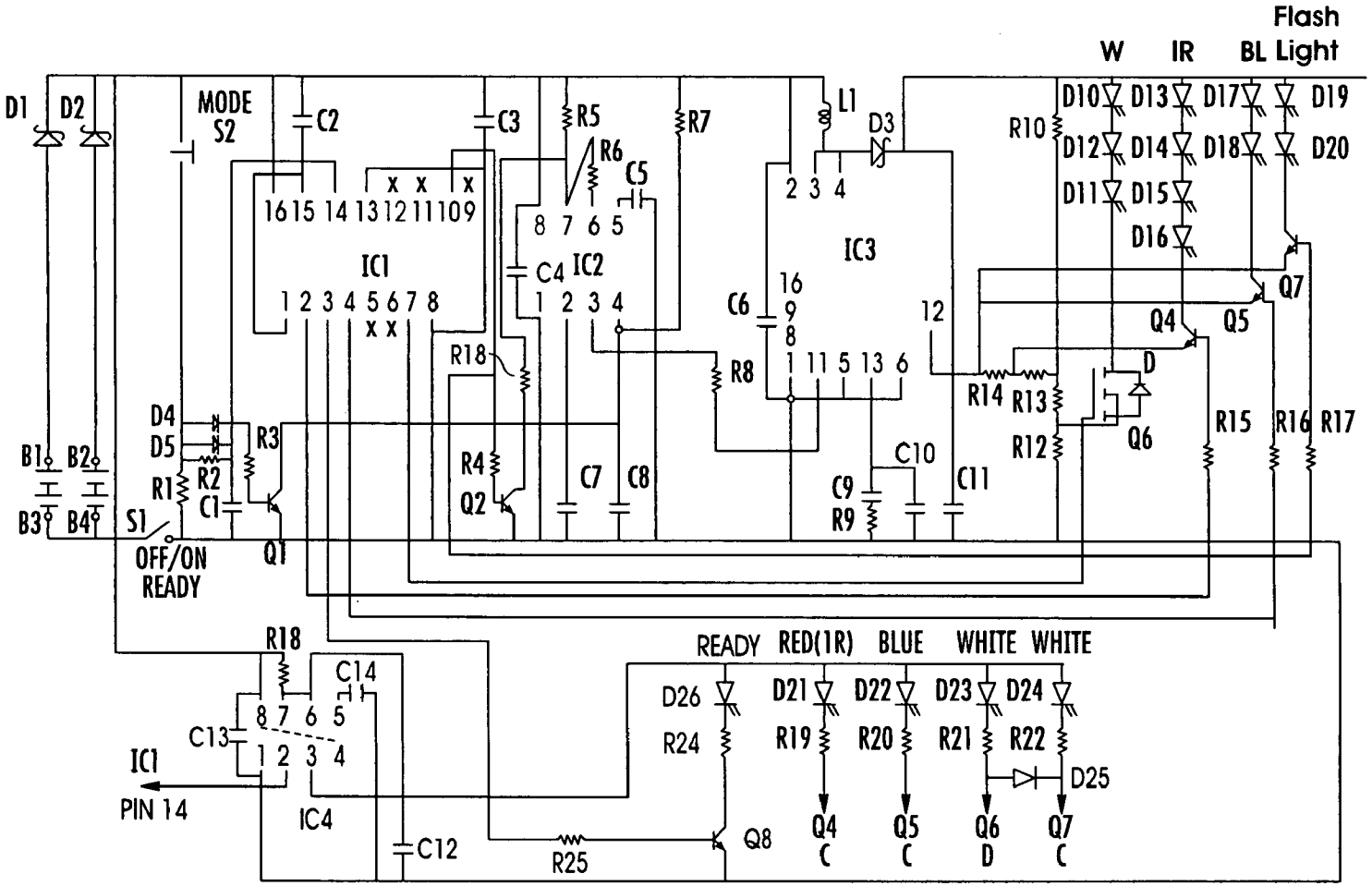
FIG. 13 is a circuit diagram for operating the distress marker of FIG. 4, according to the present invention.

FIG. 13, shows a circuit diagram of an operating circuit that is housed within distress light 200, 300 for operating LED's 224, 228, 230, 322, 324, 326, 410, 412, 414, 416, 418, 510, 520, 530, 610, 620, 630, 640, 710, 720, 730, 740, 750, and status indicators 238. As seen, the power source circuit section includes a series of Schottky diodes D1, D2 plus four CR-123 batteries B1, B2, B3, B4 displaced in two parallel sets of two series strings. The circuit may be operated with 2 or 4 CR-123 batteries. The power source circuit allows batteries to be inserted and replaced in the same polarity direction, providing the convenience of easily and quickly replacing batteries without regard to inserting the batteries in different specific polarity orientations. In one embodiment, the power source comprises two batteries, with two other batteries 359 positioned in opposite polarity between an electrical power contact 367 and a second electrical power contact 369 for storage.

The operating circuit shows mode switch S2 coupled to a 555 timer to provide a five (5) second delay mode activation. Each time mode switch S2 is depressed, a five (5) second delay is evoked for each new mode selection. Upon depressing the mode switch 234, as better illustrated in FIG. 4, a five (5) second delay is provided before activating the selected mode of operation. The five (5) second delay offers the advantages of reducing selection errors and risks of exposure that may be created from selecting a bright, white illumination. For example, a user may select the bright white light mode of operation and realize quickly thereafter, that selecting such a mode may alert unfriendly forces. Thus, a user could reselect the proper mode within the five (5) second delay without having triggered the undesired mode.

The operating circuit further includes a number of integrated circuits (ICs). IC1 is a decade counter that provides the appropriate output to operate a variety of transistors and/or FETs to operate light emitting diodes. IC2 is a flash rate control integrated circuit that controls the pulsing, time and frequency of lighting the light emitting diodes. IC3 is a voltage regulator that powers the output light emitting diodes and while additionally functions as a current regulator through the combinational workings of resistors R11 through R14. The arrangement allows changing a constant voltage regulator to a current regulator with current settings independent of the load applied. It is desirable that the circuit powers the plurality of light emitting diodes at a pulse rate between 7 and 13 flashes per second.

As seen in FIG. 13, the operating circuit includes light emitting diodes D10 through D20. D10 through D12 provide a white flashing light, D13 through D16 provide an infrared flashing light, D17 and D18 provide a Blue flashing light, and D19 and D20 provide a white solid light. A number of resistors, capacitors, transistors, and diodes are electrically coupled to provide a unique operational circuit for distress light 200 and 300.

In view of the circuit, a delay in the operation of the selected mode is provided by the mode switch S2 which, when placed in a closed circuit, drives Transistor Q1 to cause capacitor C8 to discharge. The low voltage across Capacitor C8 applied to the reset pin of integrated circuit IC2 causes Pin 3 of integrated circuit IC2 drives the output to a low state. The output of integrated circuit IC2 drives the enable pin (pin 11) of integrated circuit IC3 to a low state, which shuts down integrated circuit IC3. When mode switch S2 is placed in an open position, transistor Q1 converts to an "off" state and Capacitor C8 charges through resistor R7. Capacitor C8 and Resistor R7 are selected such to provide a 5 second delay before Capacitor C8 reaches a charge voltage sufficient to allow Integrated Circuit IC2 to function as an astabe circuit. Integrated Circuit IC2 controls the on time and flash rate of the LED's when they are in the flashing mode.

Continuing with the circuit, the status indicator operation is controlled by IC4. The integrated circuit IC4 operates as a monostable single pulse generator. This single pulse provides 5 seconds of positive voltage to power the selected status LED's. When the mode switch S2 is closed, this provides a positive pulse to pin 2 of the integrated circuit IC4. The positive pulse is provided via capacitor C1 charging through diode D5. Pin 2 of the integrated circuit IC4 only responds to a negative pulse, thus waiting until the positive pulse is removed. When the mode switch S2 opens, capacitor C1 discharges through resistors R1, R2. The discharge provides the required negative pulse to the pin 2 of the integrated circuit IC4, causing pin 3 of the integrated circuit IC4 to provide a positive five (5) second pulse, powering the mode status LED's, D21, D22, D23, D24, and D26. This limits the mode status indicating LEDS to a 5 second or less illumination. The operational timeframe of the mode indicating LEDS is limited to minimize any potential for accidental location identification by undesirable parties.

Operation of the mode selection function, selecting the operational LED's initiates when the power switch S1 is placed into a ready position. Once the power switch S1 is placed into a ready position, power is provided to the decade counter IC1. This causes the decoded output "0" of pin 3 to enter a high or "+" state (referenced as "1" when using a logical or digital state). All other outputs are toggled into a low or "−" state (referenced as "0" when using a logical or digital state). The high state of pin 3 provides power to transistor Q8, which provides power to the ready mode status indicator D26. When the mode switch S2 is cycled (pressed and released), pin 14 of integrated circuit IC1 receives a pulse. Pin 14 of integrated circuit IC1 is a clocking input. The received pulse resets the decoded output "0" from a logic state of "1" to a logic state of "0". The next sequenced output "1" is toggled from a logic state of "0" to a logic state of "1", with the balance remaining as a logic state of "0". This continues through all five of the preset outputs. This stepping sequence initiates power to the next sequentially desired light display/output. The following illustrates an exemplary sequence of outputs:

a. Output "0" (Pin 3 of IC1) powers the ready light D26
b. Output "1" (Pin 2 of IC1) powers the IR flashing light and IR indicator (red) LED's D21
c. Output "2" (Pin 4 of IC1) powers the blue flashing light and blue indicator LED D22
d. Output "3" (Pin 7 of IC1) powers the white flashing light and white indicator LED D23
e. Output "4" (Pin 10 of IC1) power the white steady light and white indicator (flashlight) LED's D23, D24
f. Output "5" (Pin 1 of IC1) is connected to a reset input (Pin 15 of IC1), which causes the sequence to reset and repeat.

It is understood that the mode indicator lights can be incorporated into a single multi-colored LED, utilising a respective circuit.

One or more embodiments of the present invention are disclosed herein. It will be understood that the claims and embodiments of the present invention are intended to be coextensive with each other, and that the embodiments are merely exemplary of the invention that may be embodied in various and alternative forms. It is noted that, according to common practice, the various features, elements and dimensions of particular embodiments are not to scale, and may be expanded, exaggerated or minimized for clarity. Thus, specific structural and functional details, dimensions, shapes, or configurations disclosed herein are not limiting but serve as a basis for teaching a person of ordinary skill in the art the described and claimed features of embodiments of the present invention.

What is claimed is:

1. A portable distress light comprising:
a housing holding a power source and a circuit;
a light assembly disposed on one end of said housing, said light assembly including a plurality of light emitting diodes coupled to the circuit;
a transparent cover disposed over said plurality of light emitting diodes;
a mode switch electrically coupled to said circuit for selectively powering said plurality of light emitting diodes to provide different lighting modes;
a plurality of status indicators, each status indicator corresponding to the lighting mode selected;
a power switch electrically coupling said power source to said circuit; and
a plurality of batteries including any one of two batteries or four batteries, and wherein said four batteries includes said two batteries for powering said control circuit, diodes and indicators, and another two batteries stored within said housing for future use.

2. The portable distress light of claim 1, wherein said transparent cover is a torridal shaped lens.

3. The portable distress light of claim 1, wherein said plurality of light emitting diodes includes top-emitting diodes, side-emitting diodes, or any combination thereof, and wherein said top-emitting diodes and side-emitting diodes are powered to provide different lighting modes including a flashing white light, a flashing infrared light, and a flashing blue light, and a solid white light.

4. The portable distress light of claim 3, wherein said control circuit includes a delay circuit, a status indicator circuit, and a mode selection circuit for selectively powering the plurality of light emitting diodes to provide different lighting modes.

5. The portable distress light of claim 4, wherein said delay circuit provides a five second delay in operation of said mode selection circuit such that there is a five second lapse before said mode selection circuit can selectively power a desired lighting mode.

6. The portable distress light of claim 5, wherein said status indicator circuit includes a monostable pulse generator to selectively operate each of said plurality of status indicators, said delay circuit electrically coupled to said status indicator circuit to activate each status indicator that corresponds to each lighting mode selected during said five second delay.

7. The portable distress light of claim 6, wherein said mode selection circuit includes a switching or linear regulator to provide preset levels of constant current to selectively power said plurality of light emitting diodes to provide said different lighting modes.

8. The portable distress light of claim 4, wherein said mode selection circuit selectively powers said plurality of light emitting diodes at a pulse rate between 7 and 13 flashes per second.

9. The portable distress light of claim 1, wherein said light assembly includes a reflector disposed over said plurality of light emitting diodes to provide a hemisphere of light, a 360 degree horizontal beam of light, and a vertical beam of light, said reflector including any one of a generally triangular shape, a generally square shape or a generally rectangular shape.

10. The portable distress light of claim 1, wherein said housing is fabricated from a durable, waterproof, lightweight material, said housing further including an attaching member for carrying or attaching said distress light to at least one of a person and an object.

11. A generally cylindrically-shaped distress light comprising:

a lighting assembly including a plurality of light emitting diodes in operational communication with a control circuit, said control circuit comprising a function to selectively operate said light emitting diodes in at least a strobe pattern;

said plurality of light emitting diodes comprising at least one top-emitting diode and at least one side emitting diode, the at least one top-emitting diode and at least one side emitting diode being assembled to a planar printed circuit assembly providing a hemisphere of emitted light;

a transparent lens disposed over said plurality of light emitting diodes;

a power source selectively coupled to said control circuit for selectively powering said diodes; and a cylindrical body housing said power source.

12. The generally cylindrically-shaped distress light of claim 11, further including a removably attached lens cover adapted to be mounted to a top portion of said cylindrical body, disposed over said plurality of light emitting diodes.

13. The generally cylindrically-shaped distress light of claim 11, wherein said plurality of light emitting diodes includes side-emitting diodes, top-emitting diodes or any combination thereof, said diodes providing a white light, an infrared light, or a blue light.

14. The generally cylindrically-shaped distress light of claim 13, wherein a side-emitting diode is centrally located on a printed circuit board, and said top emitting diodes are spatially located from said side-emitting diode on said printed circuit board, said top emitting diodes emitting light axially through said lens.

15. The generally cylindrically-shaped distress light of claim 14, wherein said side-emitting diode is positioned within a diode receiving section of said transparent lens.

16. The generally cylindrically-shaped distress light of claim 13, wherein said cylindrical body includes an upper section threadably mounted to a lower section to electrically connect said power source to said plurality of light emitting diodes to selectively power said diodes.

17. The generally cylindrically-shaped distress light of claim 11, wherein said cylindrical body is sized and dimensioned to fit to, about, or within any one of a tubular holder, a barrel shaped holder, a rifle stock clamp, a gun sight of a pistol or rifle, or a general accessory for a gun sight.

18. A portable lighting device comprising:

a housing holding a power source selectively connected to a delay circuit, a status indicator circuit and a mode selection circuit, said circuits defining a control unit;

a plurality of light emitting diodes operatively coupled to said control unit, said mode selection circuit comprising a function to selectively operate the light emitting diodes in at least a strobe pattern, said light emitting diodes defining status indicator lights, and signaling lights;

said plurality of light emitting diodes comprising at least one top-emitting diode and at least one side emitting diode, the at least one top-emitting diode and at least one side emitting diode being assembled to a planar printed circuit assembly providing a hemisphere of emitted light;

a transparent lens sealably covering said plurality of light emitting diodes;

a mode switch for selectively operating said signaling lights in a variety of different lighting modes; and a power switch electrically coupling said power source to said control unit and said plurality of light emitting diodes.

19. The portable lighting device of claim 18, wherein said plurality of light emitting diodes includes top-emitting diodes, side-emitting diodes, or any combination thereof, said plurality of light emitting diodes being powered to provide different lighting modes including a flashing white light, a flashing infrared light, and a flashing blue light, and a solid white light.

20. The portable lighting device of claim 19, further including a reflector disposed over said plurality of light emitting diodes to provide a hemisphere of light, a 360 degree horizontal beam of light, and a vertical beam of light, said reflector including any one of a generally triangular shape, a generally square shape or a generally rectangular shape.

* * * * *